US006663053B1

(12) United States Patent
Shams

(10) Patent No.: US 6,663,053 B1
(45) Date of Patent: Dec. 16, 2003

(54) SENSOR FOR RAILCAR WHEELS

(75) Inventor: Alireza Shams, East Amherst, NY (US)

(73) Assignee: Introl Design, Inc., Lockport, NY (US)

( * ) Notice: Subject to any disclaimer, the term of this patent is extended or adjusted under 35 U.S.C. 154(b) by 0 days.

(21) Appl. No.: 10/231,998

(22) Filed: Aug. 30, 2002

(51) Int. Cl.[7] ..... B61L 1/00

(52) U.S. Cl. ..... 246/249; 246/122 R; 324/179; 340/941

(58) Field of Search ..... 246/77, 122 R, 246/167 A, 247, 249, 473.1; 340/941; 324/179, 207.26

(56) References Cited

U.S. PATENT DOCUMENTS

| | | | | | |
|---|---|---|---|---|---|
| 2,973,430 | A | * | 2/1961 | Pelino | 246/249 |
| 3,392,279 | A | * | 7/1968 | Crawford | 246/249 |
| 3,395,341 | A | * | 7/1968 | Malaquin | 324/179 |
| 3,567,920 | A | * | 3/1971 | Campbell | 246/249 |
| 3,697,745 | A | | 10/1972 | Bolton | |
| 3,721,821 | A | | 3/1973 | Blanyer | |
| 3,941,338 | A | | 3/1976 | Knudsen | |
| RE30,012 | E | | 5/1979 | Wilkas et al. | |
| 4,283,031 | A | | 8/1981 | Finch | |
| 4,524,932 | A | | 6/1985 | Bodziak | |
| 5,158,253 | A | * | 10/1992 | Burghoff et al. | 246/246 |
| 5,333,820 | A | | 8/1994 | Gilcher | |
| 5,395,078 | A | | 3/1995 | Gellender | |
| 5,483,816 | A | * | 1/1996 | Nayer et al. | 73/1.01 |
| 5,628,479 | A | | 5/1997 | Ballinger | |
| 6,043,774 | A | | 3/2000 | Singh et al. | |
| 6,371,417 | B1 | | 4/2002 | Southon | |

FOREIGN PATENT DOCUMENTS

| | | |
|---|---|---|
| EP | 0 002 609 | 6/1979 |
| FR | 2 494 655 | 5/1982 |

* cited by examiner

*Primary Examiner*—Mark T. Le
(74) *Attorney, Agent, or Firm*—Michael L. Dunn

(57) ABSTRACT

Method and apparatus for detection of the presence of a train wheel on a train track that overcomes problems associated with previously known detectors. The invention includes a method for detecting the presence of a train wheel on a train track. The method includes the steps of: a) generating an electromagnetic field using at least one electromagnetic field generator sensor including a resonance tank circuit; b) providing an electrical charge to the tank circuit when amplitude of the frequency drops below a predetermined level by using a charging circuit; c) providing a feed back from the tank circuit permitting the charging circuit to determine when the amplitude of the frequency has dropped below the predetermined level; d) holding the electromagnetic field generator proximate a train rail so that a train wheel causes a drop in the frequency amplitude below a second threshold level when a train wheel partially affects the field, and so that there frequency amplitude below a third threshold level below the second threshold level when the train wheel is located so that it fully affects the field; e) detecting when there is an increase in frequency amplitude above a first threshold level indicating that the electromagnetic field generator is no longer in a proper position relative to the train rail; f) detecting when there is a change in frequency amplitude relative to the threshold levels; and g) compensating for drift of frequency amplitude between the first and second threshold levels and ceasing such compensating when the frequency amplitude is above the first threshold level or below the second threshold level. The method includes all uses of the detector and apparatus as previously described. The invention further includes apparatus for practicing the method of the invention.

47 Claims, 5 Drawing Sheets

Digital representation of the above analog signals inverted $V_{PV}$ Power-up calibration point/compensation
$V_2$ Point where AUTO Compensation is halted
$V_4$ Point where the wheel has passed
$V_3$ Point where the wheel is detected
$V_1$ Point when the sensor has fallen off the rail
$V_4 - V_3$ = the hysteresis $V_{PV}$ Power-up calibration point/compensation
$V_2$ Point where AUTO Compensation is halted
$V_4$ Point where the wheel has passed
$V_3$ Point where the wheel is detected
$V_1$ Point when the sensor has fallen off the rail
$V_4 - V_3$ = the hysteresis

SENSOR FOR RAILCAR WHEELS

BACKGROUND OF THE INVENTION

Control of trains and their movements along defined rails has been a priority since the inception of railroads. Safety concerns are many including concerns about collisions at train crossings, overtaking and colliding with stopped or slower moving trains, head on collisions when trains are traveling on the same rail in opposite directions, improper switch orientation causing trains to enter onto and travel on wrong tracks creating risk of running to the end of the track or colliding with other trains, apparatus or vehicles on the improper track, colliding with road traffic such as cars and trucks at railroad-road crossings and detection of wheel derailments and hot bearings before more serious problems result. In addition to safety concerns, control of trains is highly desirable for efficient and concentrated use of rail lines, e.g. train and car identification and location and speed of movement.

There has therefore been a continuing need for automatically detecting the presence of trains, for detecting train lengths, for determining train speeds, for detecting direction of movement and for detecting bearing problems (i.e. hot boxes) and derailments. Some earlier devices for detecting the presence of trains included pressure switches that operated upon movement of a track section due to train weight and electrical contact switches that operated conduction through train wheels at electrically insulated rail sections. These systems, while better than no automatic detection systems, had serious disadvantages. In particular, pressure switches required expensive and cumbersome apparatus of a size capable of withstanding tremendous train weight and were subject to serious maintenance problems. Further such systems could not detect train direction without using multiple costly pressure switches spaced at significant distances. Such pressure switches could not be used to determine train length, train speed or derailment conditions. Electric contact switches had the disadvantages of pressure switches and in addition required insulated rails subject to insulation breakdown and the possibility of grounding out due to conductive articles or substances, e.g. water or even snow, in contact with the rail.

Another type of detector that has been tried is the photoelectric detector. Such detectors do not work well in an environment where dirt or snow can easily block a photodetector and photodetectors are usually sensitive to shock and vibration. A further type of detector relies upon reflected radio frequency waves and resulting phase shift to determine presence and direction of a train wheel e.g., as described in U.S. Pat. No. 6,043,774. Such detectors have an advantage in that they can be small and use low power but have a serious disadvantage in that they will detect essentially anything whether magnetic or not or massive or not thus resulting in undesirable false positives. Further, such detectors are subject to radio wave interference from extraneous sources such as radio transmitters used by railroad personnel.

In the prior art, train wheel detectors using simple self controlling flux generators having inductance-capacitance tank circuits as sensors were too unreliable for use because of tendency of flux levels and detection levels to drift thus resulting in no reliable standard to use as a basis for comparison when a train wheel entered the flux zone. Such drift resulted from a number of factors including temperature changes that altered component characteristics, presence of iron shavings or powder on the sensors, minor shifting of the sensor relative to the rail, and alteration of characteristics due to component aging. Such flux modification detectors further did not naturally contain fail safe mechanisms indicating when they were operating improperly.

Nevertheless, attempts have been made to detect the presence of train wheels on a track by their affect upon a local electromagnetic field and a number of patents have been granted in this area. Such detectors are either unreliable, for reasons previously stated or are costly and complex due to attempts to overcome the disadvantages previously described. A number of such patents require both a field generator, such as a coil or permanent magnet and at least one detection coil that detects a change in flux density when a wheel flange approaches the coils. The use of both a field generator and a detection coil, or other multiple coil systems not only increases cost and complexity, the detectors are not as sensitive as desired. Examples of patents using multiple coils and or permanent magnets include U.S. Pat. Nos. Re 30,012; 3,697,745; 4,283,031; 4,524,932; 5,333,820; 5,628,479 and European Patent Application 0 002 609. Other systems, e.g. have employed the use of phase shift in an attempt to detect the presence of a train wheel. Such systems are subject to interference and are complex, e.g. as described in U.S. Pat. Nos. 5,395,078 and 3,721,821. A number of systems do not provide for compensation due to environmental factors and component aging, e.g. as described in U.S. Pat. No. 3,941,338, and still others use complex and unreliable circuitry where a microprocessor or other device is used to provide frequency generation that is then fed into a tank circuit, rather than relying upon a tank circuits own natural frequency. Examples of such patents include U.S. Pat. No. 6,371,417 and French patent application 80 25496.

Up to now, no known system has had the desired combination of properties of simplicity, reliability, including compensation, direction detection, and fail safe detection afforded by the apparatus and method of the present invention.

BRIEF DESCRIPTION OF THE INVENTION

Figure 1:
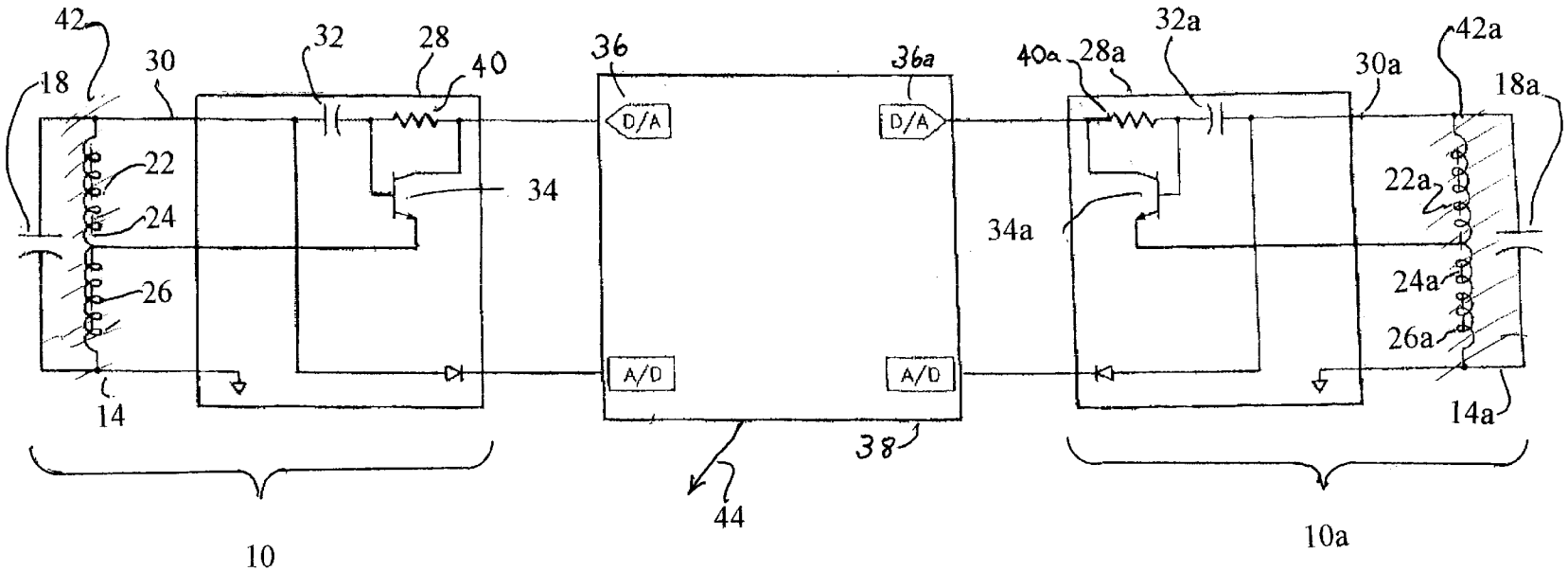
FIG. 1 is combined circuit block diagram showing a preferred embodiment of the detector of the invention.

In accordance with the invention, method and apparatus are provided for detection of the presence of a train wheel on a train track that overcomes problems associated with previously known detectors. In particular, the method and apparatus of the present invention take advantage of all of the good characteristics of a self controlling tank circuit while only using microprocessor intervention when necessary to calibrate the tank circuit, prevent drift, provide fail safe information and record and transmit information. The method and apparatus are thus highly reliable but simpler in design than those previously known.

The invention includes a method for detecting the presence of a train wheel on a train track. In particular, the method includes the steps of:

a) generating an electromagnetic field using at least one electromagnetic field generator sensor comprising: an inductance-capacitance (L/C) loop tank circuit that develops an alternating current at a natural resonance frequency to provide an electromagnetic field when the L/C tank circuit is electrically charged;

b) providing an electrical charge to the tank circuit when amplitude of the frequency drops below a predetermined level by using a charging circuit;

c) providing a feed back from the tank circuit to the charging circuit at the resonance frequency permitting the charging circuit to determine when the amplitude of the frequency has dropped below the predetermined level where the L/C tank circuit and charging circuit are incapable of maintaining the predetermined amplitude of the frequency when a ferromagnetic material of the mass of a train wheel is located in a center of the field;

d) holding the electromagnetic field generator proximate a train rail so that the electromagnetic field extends through a spatial area through which a train wheel travels and so that the field is affected to cause a drop in the frequency amplitude below a second threshold level that is below the predetermined level when a train wheel is located on the rail so that it partially affects the field, and so that there is a further drop in frequency amplitude below a third threshold level below the second threshold level when the train wheel is located so that it fully affects the field;

e) detecting when there is an increase in frequency amplitude above a first threshold level above the predetermined level indicating that the electromagnetic field generator is no longer in a proper position relative to the train rail;

f) detecting when there is a drop in frequency amplitude below the second threshold level to indicate approach of the train wheel;

g) detecting when there is a drop in frequency amplitude below the third threshold level to indicate the presence of the train wheel; and h) compensating for drift of frequency amplitude from the predetermined level when the drift is between the first and third threshold levels and ceasing such compensating when the frequency amplitude is above the first threshold level or below the second threshold level.

The method includes all uses of the detector and apparatus as previously described.

The invention further includes apparatus for practicing the method of the invention.

DETAILED DESCRIPTION OF THE INVENTION

In accordance with the invention, the detector of the invention includes at least one self controlling electromagnetic field generator sensor including a inductance-capacitance (L/C) tank circuit, i.e. a capacitance and inductance in series or parallel (preferably parallel) where an electrical charge continuously alternatively resonates at its own natural frequency between charging and discharging the capacitor and charging and discharging an inductor creating an alternating current within the tank circuit and a surrounding alternating electromagnetic flux. "Self controlling, as used herein, means that natural resonance frequency of the tank circuit is used to generate an electromagnetic flux field and that the tank circuit is electrically charged only when feedback from the tank circuit to an analog transistor circuit indicates that frequency amplitude has dropped to a sufficient level (predetermined level) to require that the tank circuit be recharged. Such a circuit is exceedingly reliable and simple and does not attempt to fight or overcome the natural properties of the tank circuit as occurs in prior art flux detectors.

The inductance in the inductance-capacitance (L/C) tank circuit is preferably a ferrite material core surrounded by an insulated radially wound electrically conductive wire that provides a sufficient inductance to operate in conjunction with the capacitance to form the alternating current at the natural resonance frequency of the tank circuit to provide the electromagnetic field when the L/C tank circuit is electrically charged. The presence of the ferrite material core increases flux density.

A charging circuit is provided that provides an electrical charge to the tank circuit when amplitude of the frequency drops below a predetermined level. The charging circuit is controlled by feed back from the tank circuit to the charging circuit at the resonance frequency permitting the charging circuit to determine when the amplitude of the tank circuit frequency has dropped below the predetermined level thus causing the charging circuit to recharge the tank circuit. In a preferred embodiment, the charging circuit includes a switch having a transistor that is activated by feed back from the tank circuit to the base of the transistor to permit charging of the tank circuit when amplitude of the frequency drops below the predetermined level.

The predetermined level is preferably between 70 and 85 percent of the voltage available to drive the charging circuit. The predetermined level is usually from about 3.5 to about 6 volts. In a preferred embodiment, in order to permit the predetermined level to be below the voltage available to drive the charging circuit, a resistance is provided between the collector and base of the transistor. Transistors, as well as other electronic components, have operating curves that are not ideal, that is they do not operate linearly over their entire range of operation. Transistors are usually operated in their linear range and great effort is often expended to accomplish that goal. In the present invention, it has nevertheless been surprisingly found that the transistor should be operated near its current saturation point, at an exponential portion of its operating curve so that minor changes in flux density around the tank circuit to not translate to large changes in frequency amplitude. It has thus been found that the value of the resistance is preferably controlled such that the ratio of the resistance to the inductance of the tank circuit is from about 1:20 to about 1:40 ohms to mH to control sensitivity of the detector, otherwise minor fluctuations in flux density can result in large changes in frequency amplitude thus increasing risk of false positive detection of a train wheel.

The L/C tank circuit and charging circuit are of insufficient power to maintain the predetermined amplitude of the frequency when a ferromagnetic material of the mass of a train wheel is located in a center of the field. The field thus at least partially collapses in the presence of the ferromagnetic mass of a train wheel so that there is a detectable drop in the amplitude of the frequency below the predetermined amplitude.

It should also be understood that the field is partially dampened by the ferromagnetic material of a train rail thus an increase in frequency amplitude above a first threshold level above and at a fixed difference from the predetermined level indicates that the electromagnetic field generator is no longer in a proper position relative to the train rail. Detecting such a rise in frequency amplitude is a fail safe mechanism that again takes advantage of the natural characteristics of the tank circuit without the need for other complex mechanisms to determine dislodgment of the sensor.

Apparatus is provided for holding the electromagnetic field generator proximate a train rail so that the electromagnetic field extends through a spatial area through which a train wheel travels and so that the field is affected to cause a drop in the frequency amplitude below a second threshold level that is below and at a fixed difference from the predetermined level when a train wheel is located on the rail so that it partially affects the field, and so that there is a further drop in frequency amplitude below a third threshold level below and at a fixed difference from the second threshold level when the train wheel is located so that it fully affects the field.

Apparatus, usually in the form of a microprocessor, is provided for recognizing an increase in frequency amplitude above a first threshold level above the predetermined level indicating that the electromagnetic field generator is no longer in a proper position relative to the train rail. Such apparatus also recognizes the drop in frequency amplitude below the second threshold level to indicate approach of the train wheel, and recognizes the drop in frequency amplitude below the third threshold level to indicate the presence of the train wheel. The microprocessor measures and records the change in amplitude and compares the change with preprogrammed and stored threshold values to determine whether a train wheel may have partially affected the field (a frequency amplitude below the second threshold value), and to determine whether there is sufficient drop to positively indicate the presence of a train wheel (a frequency amplitude drop below the third threshold value).

Apparatus is provided for compensating for drift of frequency amplitude from the predetermined level to obtain a new adjusted predetermined level when the drift is between the first and second threshold levels and for ceasing such compensating when the frequency amplitude is above the first threshold level or below the second threshold level. "Drift" as used herein means a slow change in frequency amplitude, as opposed to an abrupt change. A slow change is considered to be a change that occurs in small increments over a long period, e.g. less than one percent change in fifteen seconds. Such apparatus may also be in the form of a microprocessor and may be the same microprocessor measuring, recording and comparing changes in amplitude to determine the presence of a train wheel. The apparatus for compensating for drift provides compensation to the transistor to prevent drift by the switch, in providing of charging of the tank circuit, when amplitude of the frequency varies from the predetermined level between the first and second thresholds. The charging circuit is adjusted by the microprocessor to compensate for temperature changes, for accumulation of metal shavings or other minor metal materials near the inductance-capacitance (L/C) loop tank circuit and for aging of electronic components and the compensation is halted by the microprocessor when a train wheel partially affects the field so that the frequency amplitude drops below the second threshold value.

The detector also includes apparatus for measuring frequency amplitude upon power up and uses resulting power up information to adjust voltage applied to the transistor until the predetermined frequency amplitude, usually at from about 4 to about 6 volts, is obtained. Again, the apparatus may be a microprocessor and may be the same microprocessor used for measuring, recording and comparing changes in amplitude to determine the presence of a train wheel and to compensate for drift. In the same way, the frequency amplitude may be continuously monitored and compared with power up information and the difference used to determine dislocation or misalignment of sensors and a fail safe signal output may be initiated by the microprocessor when a positive difference determined by subtracting the power up information from the monitored frequency amplitude exceeds the first threshold level.

For many applications, especially when direction of train movement is important, at least two of the electromagnetic field generator sensors are held proximate a train rail in a spaced relationship to each other so that the electromagnetic fields extend from the sensors through a plurality of spatial areas through which a train wheel travels so that direction of travel can be determined by determining the order in which generated fields collapse to cause indicative drops in the frequency amplitudes when a train wheel passes through the fields. The dual spaced electromagnetic field generator sensors are preferably packaged in a single package unit having a single apparatus, e.g. a computer, for recognizing the changes in frequency amplitude for both field generator sensors. The dual spaced electromagnetic field generators operate independently at different natural resonance frequencies so that drops in frequency amplitude can be measured with respect to each field generator sensor without interference from the other field generator sensor permitting bidirectional sensing and counting.

Passage of a wheel over the aligned spaced field generator sensors permits measurement of four relative states of drops in frequency amplitude corresponding to initial positive detection of the wheel by a first sensor without detection by the second sensor indicating the presence of a wheel, positive detection by both sensors, positive detection by the second sensor without detection by the first sensor and lack of detection by either sensor indicating that the wheel has passed. Wheel direction and speed can thus be determined by the microprocessor from the order of sensors affected and times between wheel detection by the sensors.

In accordance with the invention, a plurality of the single package units previously described can be used in a detector system for controlling train movement. Such a system can control track switching due to detection or lack of detection of train wheels, count moving train wheels, calculate the number of cars in a train based upon the number of counted wheels and provide a signal indicating train length. Such a system can detect the presence or absence of a moving train wheel indicating the presence or absence of a moving train and provide a control signal to a device based upon the presence or absence of a moving train. The device may for example be a signaling device, a gate, a car identification reader or an overheat detector, e.g. for detecting overheated wheel bearings known as a "hot box".

The invention further includes method for detecting the presence of a train wheel on a train track including the steps of a) generating an electromagnetic field using at least one electromagnetic field generator sensor comprising: an inductance-capacitance (L/C) loop tank circuit that develops an alternating current at a natural resonance frequency to provide an electromagnetic field when the L/C tank circuit is electrically charged;

b) providing an electrical charge to the tank circuit when amplitude of the frequency drops below a predetermined level by using a charging circuit;

c) providing a feed back from the tank circuit to the charging circuit at the resonance frequency permitting the charging circuit to determine when the amplitude of the frequency has dropped below the predetermined level where the L/C tank circuit and charging circuit are incapable of maintaining the predetermined amplitude of the frequency when a ferromagnetic material of the mass of a train wheel is located in a center of the field;

d) holding the electromagnetic field generator proximate a train rail so that the electromagnetic field extends through a spatial area through which a train wheel travels and so that the field is affected to cause a drop in the frequency amplitude below a second threshold level that is below the predetermined level when a train wheel is located on the rail so that it partially affects the field, and so that there is a further drop in frequency amplitude below a third threshold level below the second threshold level when the train wheel is located so that it fully affects the field;

e) detecting when there is an increase in frequency amplitude above a first threshold level above the predetermined level indicating that the electromagnetic field generator is no longer in a proper position relative to the train rail;

f) detecting when there is a drop in frequency amplitude below the second threshold level to indicate approach of the train wheel;

g) detecting when there is a drop in frequency amplitude below the third threshold level to indicate the presence of the train wheel; and h) compensating for drift of frequency amplitude from the predetermined level when the drift is between the first and second threshold levels and ceasing such compensating when the frequency amplitude is above the first threshold level or below the second threshold level.

The method includes all uses of the detector and apparatus as previously described.

The method and detector of the invention can be further understood by reference to the drawings depicting a preferred embodiment of the invention.

As best seen in FIG. 1 dual field generator sensors 10 and 10*a* each include a self controlling electromagnetic field generator 14 and 14*a* in the form of tank circuits having capacitors 18 and 18*a* in parallel with inductors 22 and 22*a* respectively. Each inductor is provided with a ferrite metal core 24 and 24*a* surrounded by an insulated radially wound electrically conductive wire 26 and 26*a* for operation in conjunction with capacitors 18 and 18*a* to form resonant tank circuits that naturally operate at similar but different frequencies due to slightly different capacitance or inductance values. The tank circuits 14 and 14*a* provide an electromagnetic field at their natural frequencies when charged.

Charging circuits 28 and 28*a* provide electrical charge to the tank circuits 14 and 14*a* respectively. The charging circuits 28 and 28*a* are controlled by feed back from tank circuits 14 and 14*a* through lines 30 and 30*a* and capacitors 32 and 32*a*. The charging circuits include switches in the form of transistors 34 and 34*a* that are activated by feed back from the tank circuits to the bases of the transistors so that when the amplitude of the frequency drops below a predetermined level of about 5 volts determined by the value of the capacitance, resistance and specifications of the transistor and available voltage from digital to analog converters 36 and 36*a*, the transistor is activated to permit charging from the transistors to the coils 26 of inductors 22 and 22*a*. The predetermined level is between 70 and 85 percent of the voltage available from digital to analog converters 36 and 36*a* that may be an integral part of microprocessor 38.

In order to permit the predetermined level to be below the voltage available from the microprocessor to drive the charging circuits 10 and 10*a*, a resistance 40, 40*a* is provided between the base and collector of the transistors. Resistance 40, 40*a* is selected to permit the transistors to operate near their current saturation point, e.g. between 80 and 95 percent of saturation. This permits a change in flux density around the tank circuit that is less than created by the mass of a ferromagnetic train wheel to be disregarded. The resistance is typically between 75 k ohms and 150 k ohms.

Figure 2:
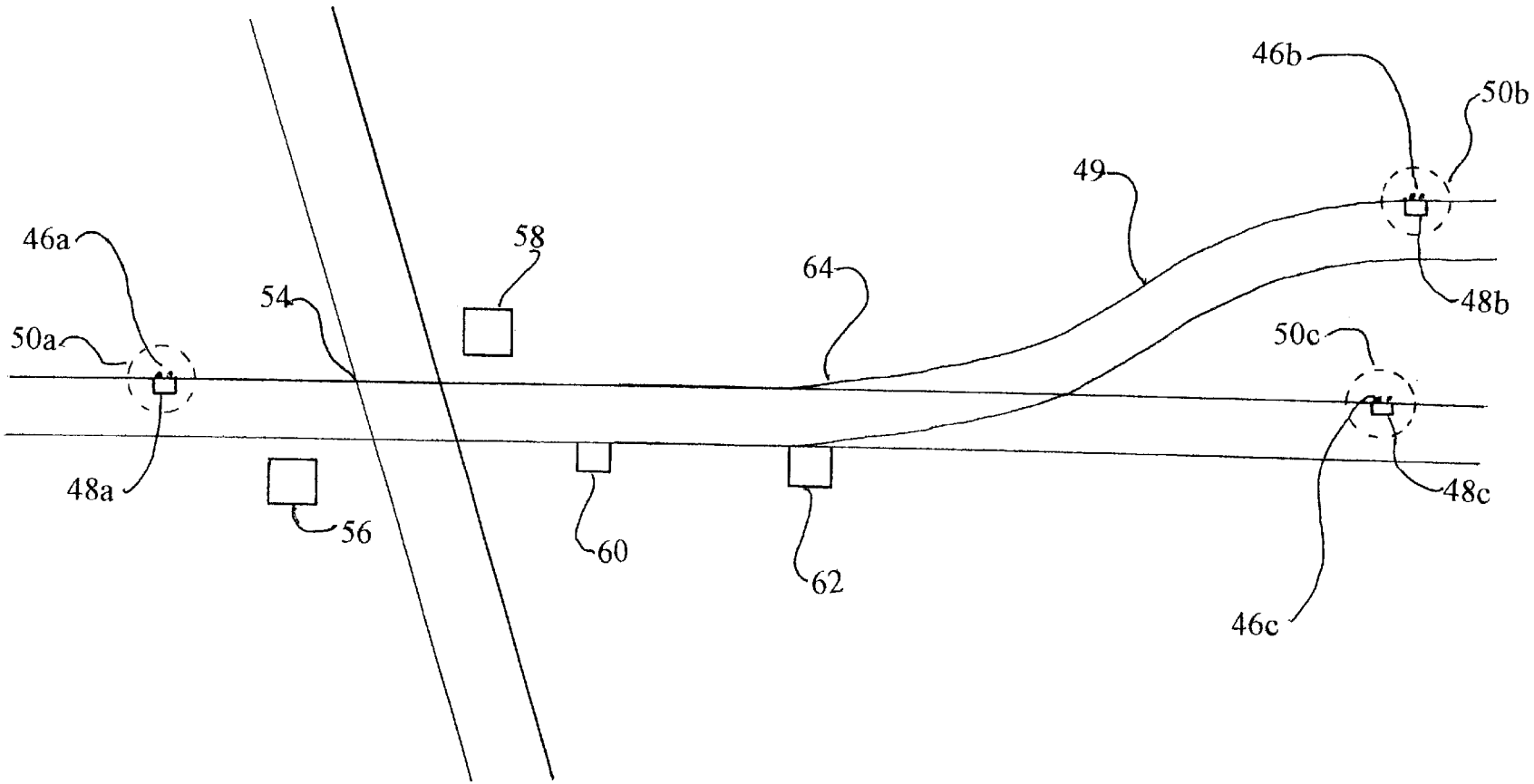
FIG. 2 shows a railroad track system incorporating detectors of the invention.
Figure 3:
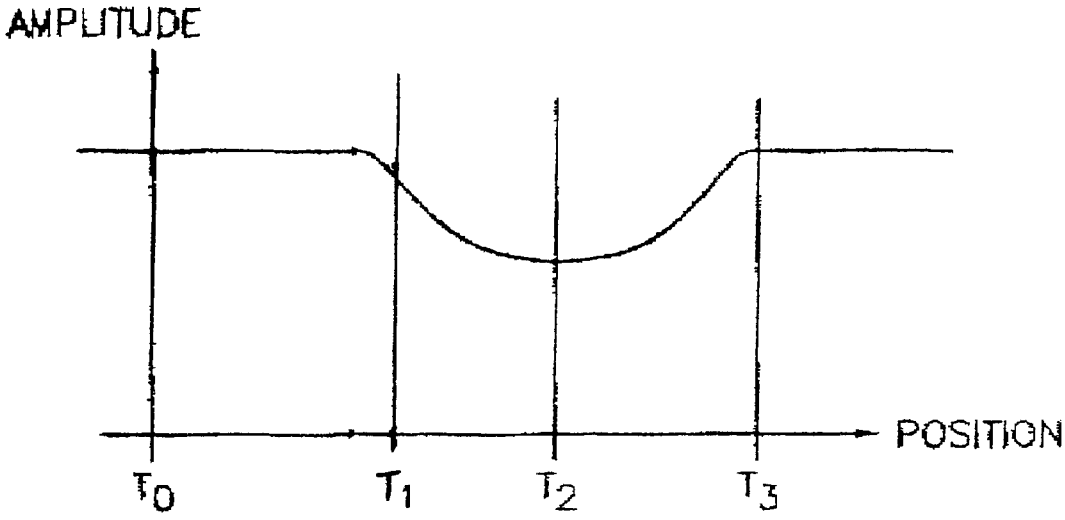
FIG. 3 shows a frequency amplitude curve as a train wheel approaches and passes through a field provided by a sensor of the invention.
Figure 4:
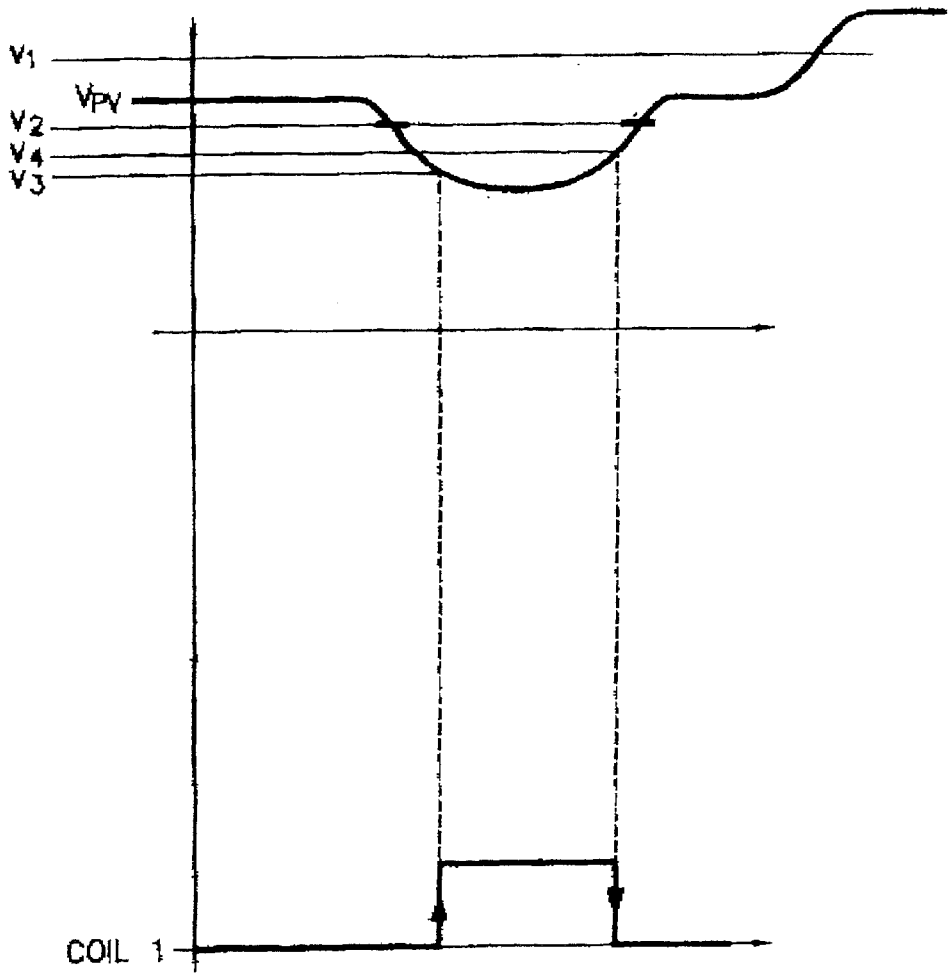
FIG. 4 shows a frequency amplitude curve for a single sensor mounted on a train rail.

The L/C tank circuits 14 and 14*a* operate at insufficient power to maintain the amplitude of the frequency when a ferromagnetic mass the size of a train wheel is located in the center of the field 42, 42*a*. The field thus at least partially collapses in the presence of a ferromagnetic mass the size of a train wheel so that there is a detectable drop in amplitude. When the train wheel enters the field as shown by positions $T_1$ and $T_2$ in FIG. 3, representing frequency amplitude when a wheel first enters the field and the frequency amplitude when the wheel is directly centered over the tank circuit, the frequency amplitude drops. When the detector is mounted near a train rail, as shown in FIG. 2, the rail dampens the frequency amplitude to the predetermined level thus if the detector is dislodged from the rail, there will be a spike in frequency amplitude represented by first threshold level $V_1$ as shown in FIG. 4. Microprocessor 38 can then recognize the spike above threshold level one and sent a warning signal through output 44.

Figure 5:
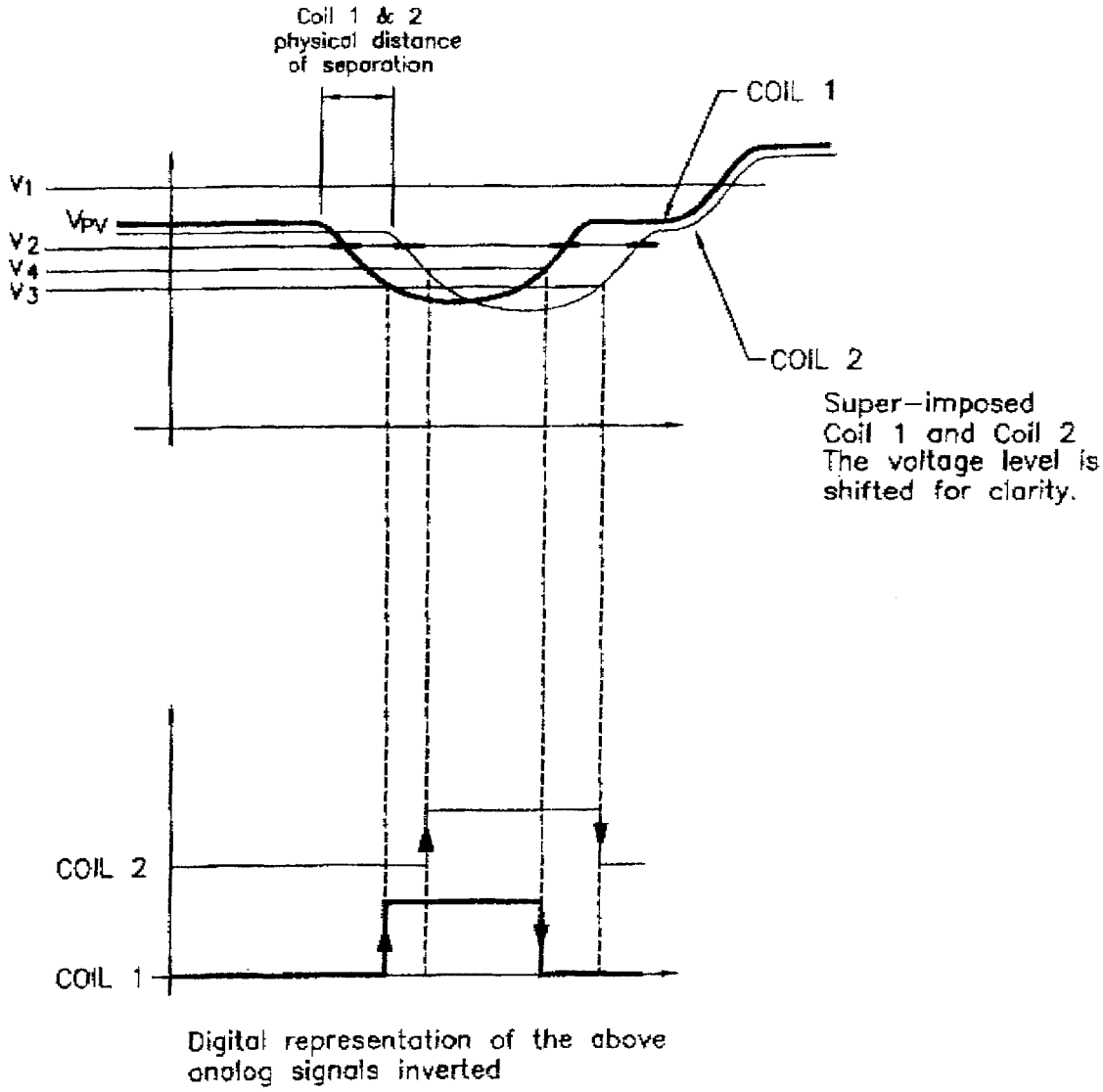
FIG. 5 shows a combined frequency amplitude curve for sensors of the invention aligned along a train rail where the sensors have overlapping but not coextensive fields as a train wheel approaches and passes the sensors.

The detectors 10 and 10*a*, including the sensors, charging circuits and accompanying microprocessor in a water tight package 48, are held to the rails 49 by bolts 46 as seen in FIG. 2 so that the fields 42 and 42*a* extend through a spatial areas 50 through which a train wheel travels so that the field is affected to cause a drop in the frequency amplitude below a second threshold level $V_2$ that is below and at a fixed difference from the predetermined level $V_{pv}$ as shown in FIGS. 4 and 5 when a train wheel is located on the rail so that it partially affects the field and so that there is a further drop in frequency amplitude below a third threshold level $V_3$ below and at a fixed difference from the second threshold level when the train wheel is located directly above the sensor. When the train wheel passes the detector, the frequency amplitude again increases to the predetermined level and passage of the train wheel can be recognized at a fourth threshold level $V_4$ just below the predetermined level. Microprocessor 38 recognizes the changes in frequency amplitude relative to the threshold levels and provides information to exterior devices through output 44 based thereon as previously described.

The microprocessor also compensates for drift in the predetermined level and makes adjustments to obtain a new adjusted predetermined level by providing variation to the supply voltage to the transistors as previously described both during power up and during operation.

FIG. 5 shows variance of frequency amplitude for two sensors mounted so that their fields overlap but are not coextensive. It can be seen that the frequency amplitudes are different in relation to threshold values depending upon wheel position.

As seen in FIG. 2, a plurality of single package units can be used detecting and controlling train movement and other operations. For example, dual sensor 48 can detect train movement toward surface road crossing 54 and provide an activating signal to signaling device 56 and simultaneously activate car number counter and hot box detector 60. A signal can also be sent to switch control 62 to throw switch 64 to direct the train toward dual detector 48*b*. Dual detector 48*a* can also up count the passing wheels and sent the number to detector 48*b* which can down count the wheels. After all wheels have been down counted, detector 48*b* can then send a signal to switch control 62 to reset the switch to its original position.

What is claimed is:

1. A detector for the presence of a train wheel on a train track comprising:

a) at least one electromagnetic field generator sensor comprising: an inductance-capacitance (L/C) loop tank circuit that develops an alternating current at a natural resonance frequency to provide an electromagnetic field when the L/C tank circuit is electrically charged; a charging circuit that provides an electrical charge to the tank circuit when amplitude of the frequency drops below a predetermined level; and a feed back from the tank circuit to the charging circuit at the resonance frequency permitting the charging circuit to determine when the amplitude of the frequency has dropped below the predetermined level; said L/C tank circuit and charging circuit being incapable of maintaining the predetermined amplitude of the frequency when a ferromagnetic material of the mass of a train wheel is located in a center of the field;

b) at least one means for holding the electromagnetic field generator proximate a train rail so that the electromagnetic field extends through a spatial area through which a train wheel travels and so that the field is affected to cause a drop in the frequency amplitude below a second threshold level that is below the predetermined level when a train wheel is located on the rail so that it partially affects the field, and so that there is a further drop in frequency amplitude below a third threshold level below the second threshold level when the train wheel is located so that it filly affects the field;

c) at least one means for detecting an increase in frequency amplitude above a first threshold level above the predetermined level indicating that the electromagnetic field generator is no longer in a proper position relative to the train rail, for detecting the drop in frequency amplitude below the second threshold level to indicate approach of the train wheel, and for detecting the drop in frequency amplitude below the third threshold level to indicate the presence of the train wheel; and d) a means for compensating for drift of frequency amplitude from the predetermined level when the drift is between the first and third threshold levels and for ceasing such compensating when the frequency amplitude is above the first threshold level or below the second threshold level.

2. The detector of claim 1 wherein the charging circuit comprises a switch having a transistor that is activated by means of feed back from the tank circuit to the base of the transistor to permit charging of the tank circuit when amplitude of the frequency drops below the predetermined level.

3. The detector of claim 2 wherein the means for compensating for drift is a means for providing compensation to the transistor to prevent drift by the switch, in providing of charging of the tank circuit, when amplitude of the frequency drops below the predetermined level.

4. The detector of claim 2 wherein the predetermined level is between 70 and 85 percent of the voltage available to drive the charging circuit.

5. The detector of claim 4 where a resistance is provided between the collector and base of the transistor to permit the predetermined level to be below the voltage available to drive the charging circuit.

6. The detector of claim 5 wherein the ratio of the resistance of the resistor to the inductance of the tank circuit is from about 1:20 to about 1:40 ohms to mH to control sensitivity of the detector.

7. The detector of claim 4 wherein the predetermined level is from about 3.5 to about 6 volts.

8. The detector of claim 1 comprising at least two of said electromagnetic field generator sensors and a plurality of means for holding the electromagnetic field generator sensors proximate a train rail in a spaced relationship to each other so that the electromagnetic fields extend from the sensors through a plurality of spatial areas through which a train wheel travels so that direction of travel can be determined by determining the order in which generated fields collapse to cause indicative drops in the frequency amplitudes when a train wheel passes through the fields.

9. The detector of claim 8 wherein dual spaced electromagnetic field generator sensors are packaged in a single package units having a single means for detecting the drop in frequency amplitude for both field generator sensors.

10. The detector of claim 1 wherein the inductance-capacitance (L/C) loop tank circuit comprises an inductor comprising a ferrite material core surrounded by an insulated radially wound electrically conductive wire that provides a sufficient inductance to operate in conjunction with the capacitance to form the alternating current at the natural resonance frequency to provide the electromagnetic field when the L/C tank circuit is electrically charged.

11. The detector of claim 1 wherein a microprocessor measures and records the change in amplitude and compares the change with preprogrammed and stored threshold values to determine whether a train wheel may have partially affected the field, and to determine whether there is sufficient drop to positively indicate the presence of a train wheel.

12. The detector of claim 3 wherein the output of the charging circuit is adjusted by the microprocessor to compensate for temperature changes and for accumulation of metal shavings near the inductance-capacitance (L/C) loop tank circuit and the compensation is halted by the microprocessor when a train wheel partially affects the field so that the frequency amplitude drops below the second threshold value.

13. The detector of claim 9 wherein the dual spaced electromagnetic field generators operate independently at different natural resonance frequencies so that drops in frequency amplitude can be measured with respect to each field generator sensor without interference from the other field generator sensor permitting bidirectional sensing and counting.

14. The detector of claim 13 wherein passage of a wheel over the aligned spaced field generator sensors permits measurement of four states of drops in frequency amplitude corresponding to initial positive detection of the wheel by a first sensor without detection by the second sensor indicating the presence of a wheel, positive detection by both sensors, positive detection by the second sensor without detection by the first sensor and lack of detection by either sensor indicating that the wheel has passed.

15. The detector of claim 2 wherein the microprocessor measures frequency amplitude upon power up and uses resulting power up information to compensate for position of field generator sensors.

16. The detector of claim 15 wherein frequency amplitude is continuously monitored and compared with power up information and the difference is used to determine dislocation or misalignment of sensors.

17. The detector of claim 16 where a fail safe signal output is initiated by the microprocessor when a positive difference determined by subtracting the power up information from the monitored frequency amplitude exceeds a fail safe threshold level.

18. A detector system for controlling train movement comprising a plurality of the single package units of claim 9.

19. The system of claim 18 wherein the detector system controls track switching due to detection or lack of detection of train wheels.

20. The system of claim 18 wherein the detector system counts moving train wheels, calculates the number of cars in a train based upon the number of counted wheels and provides a signal indicating train length.

21. The system of claim 18 wherein the detector system detects the presence or absence of a moving train wheel indicating the presence or absence of a moving train and provides a control signal to a device based upon the presence or absence of a moving train.

22. The system of claim 21 wherein the device is a signaling device.

23. The system of claim 21 wherein the device is a gate.

24. The system of claim 21 wherein the device is car identification reader.

25. The system of claim 21 wherein the device is an overheat detector.

26. A method for detecting the presence of a train wheel on a train track comprising:

a) generating an electromagnetic field by means of at least one electromagnetic field generator sensor comprising: an inductance-capacitance (L/C) loop tank circuit that develops an alternating current at a natural resonance frequency to provide an electromagnetic field when the L/C tank circuit is electrically charged;

b) providing an electrical charge to the tank circuit when amplitude of the frequency drops below a predetermined level by means of a charging circuit;

c) providing a feed back from the tank circuit to the charging circuit at the resonance frequency permitting the charging circuit to determine when the amplitude of the frequency has dropped below the predetermined level where the L/C tank circuit and charging circuit are incapable of maintaining the predetermined amplitude of the frequency when a ferromagnetic material of the mass of a train wheel is located in a center of the field;

d) holding the electromagnetic field generator proximate a train rail so that the electromagnetic field extends through a spatial area through which a train wheel travels and so that the field is affected to cause a drop in the frequency amplitude below a second threshold level that is below the predetermined level when a train wheel is located on the rail so that it partially affects the field, and so that there is a further drop in frequency amplitude below a third threshold level below the second threshold level when the train wheel is located so that it fully affects the field;

e) detecting when there is an increase in frequency amplitude above a first threshold level above the predetermined level indicating that the electromagnetic field generator is no longer in a proper position relative to the train rail;

f) detecting when there is a drop in frequency amplitude below the second threshold level to indicate approach of the train wheel;

g) detecting when there is a drop in frequency amplitude below the third threshold level to indicate the presence of the train wheel; and h) compensating for drift of frequency amplitude from the predetermined level when the drift is between the first and second threshold levels and ceasing such compensating when the frequency amplitude is above the first threshold level or below the second threshold level.

27. The method of claim 26 wherein a transistor in the charging circuit is activated by means of feed back from the tank circuit to the base of the transistor to permit charging of the tank circuit when amplitude of the frequency drops below the predetermined level.

28. The method of claim 27 comprising providing compensation to the transistor to prevent drift by the switch, in providing of charging of the tank circuit, when amplitude of the frequency drops below the predetermined level.

29. The method of claim 26 wherein the predetermined level is between 70 and 85 percent of voltage available to drive the charging circuit.

30. The method of claim 27 comprising providing a resistance between the collector and base of the transistor to permit the predetermined level to be below the voltage available to drive the charging circuit.

31. The method of claim 30 wherein the ratio of the resistance to the inductance of the tank circuit is from about 1:20 to about 1:40 ohms to mH to control sensitivity of the detector.

32. The method of claim 26 wherein the predetermined level is from about 3.5 to about 6 volts.

33. The method of claim 26 comprising using at least two of said electromagnetic field generator sensors and a plurality of means for holding the electromagnetic field generator sensors proximate a train rail in a spaced relationship to each other so that the electromagnetic fields extend from the sensors through a plurality of spatial areas through which a train wheel travels so that direction of travel can be determined by determining the order in which generated fields collapse to cause indicative drops in the frequency amplitudes when a train wheel passes through the fields.

34. The method claim 33 wherein dual spaced electromagnetic field generator sensors are packaged in a single package units having a single means for detecting drop in frequency amplitude for both field generator sensors.

35. The method of claim 34 wherein the single means comprises a microprocessor.

36. The method of claim 26 wherein the inductance-capacitance (L/C) loop tank circuit comprises an inductor comprising a ferrite material core surrounded by an insulated radially wound electrically conductive wire that provides a sufficient inductance to operate in conjunction with the capacitance to form the alternating current at the natural resonance frequency to provide the electromagnetic field when the L/C tank circuit is electrically charged.

37. The method of claim 26 wherein a microprocessor measures and records the change in amplitude and compares the change with preprogrammed and stored threshold values to determine whether a train wheel may have partially affected the field, and to determine whether there is sufficient drop to positively indicate the presence of a train wheel.

38. The method of claim 37 wherein the output of the charging circuit is adjusted by a microprocessor to compensate for temperature changes and for accumulation of metal shavings near the inductance-capacitance (L/C) loop tank circuit and the compensation is halted by the microprocessor when a train wheel partially affects the field so that the frequency amplitude drops below the second threshold value.

39. The method of claim 38 wherein dual spaced electromagnetic field generators aligned along a rail operate independently at different natural resonance frequencies so that drops in frequency amplitude can be measured with respect to each field generator sensor without interference from the other field generator sensor permitting bi-directional sensing and counting.

40. The detector of claim 39 wherein passage of a wheel over the aligned spaced field generator sensors permits measurement of four states of drops in frequency amplitude corresponding to initial positive detection of the wheel by a first sensor without detection by the second sensor indicating the presence of a wheel, positive detection by both sensors, positive detection by the second sensor without detection by the first sensor and lack of detection by either sensor indicating that the wheel has passed.

41. The detector of claim 40 wherein the microprocessor measures frequency amplitude upon power up and uses resulting power up information to compensate for position of field generator sensors.

42. The detector of claim 41 wherein frequency amplitude is continuously monitored by the microprocessor and compared with power up information and the difference is used to determine dislocation or misalignment of sensors.

43. The detector of claim 26 where a fail safe signal output is initiated by a microprocessor when a positive difference determined by subtracting the power up information from the monitored frequency amplitude exceeds a fail safe threshold level.

44. A method for controlling train movement comprising using a plurality of the single package units of claim 9.

45. The method of claim 44 wherein the detector system controls track switching due to detection or lack of detection of train wheels.

46. The method of claim 44 wherein the detector system counts moving train wheels, calculates the number of cars in a train based upon the number of counted wheels and provides a signal indicating train length.

47. The method of claim 44 wherein the detector system detects the presence or absence of a moving train wheel indicating the presence or absence of a moving train and provides a control signal to a device based upon the presence or absence of a moving train.

* * * * *